US007861842B2

(12) United States Patent
Arifon

(10) Patent No.: US 7,861,842 B2
(45) Date of Patent: Jan. 4, 2011

(54) MACHINE FOR DISPENSING PRODUCTS AND/OR SERVICES, WHICH IS EQUIPPED WITH A BANKNOTE READER

(75) Inventor: Jean Arifon, St Vit (FR)

(73) Assignee: Parkeon, Paris (FR)

( * ) Notice: Subject to any disclaimer, the term of this patent is extended or adjusted under 35 U.S.C. 154(b) by 491 days.

(21) Appl. No.: 11/995,030

(22) PCT Filed: Jul. 7, 2006

(86) PCT No.: PCT/FR2006/001649

§ 371 (c)(1),
(2), (4) Date: Mar. 19, 2008

(87) PCT Pub. No.: WO2007/006949

PCT Pub. Date: Jan. 18, 2007

(65) Prior Publication Data

US 2010/0116618 A1 May 13, 2010

(30) Foreign Application Priority Data

Jul. 8, 2005 (FR) ..... 05 52120

(51) Int. Cl.
*G07F 7/04* (2006.01)

(52) U.S. Cl. ..... 194/206; 194/348

(58) Field of Classification Search ..... 194/206, 194/344, 345, 350, 348, 351; 463/46; 902/17
See application file for complete search history.

(56) References Cited

U.S. PATENT DOCUMENTS 5,605,214 A * 2/1997 Yukimoto et al. ..... 194/348
5,632,367 A 5/1997 Bergeron et al.
2003/0126022 A1 7/2003 Chou

FOREIGN PATENT DOCUMENTS

DE 203 06 829 U1 6/2003
GB 2 401 982 A 11/2004

OTHER PUBLICATIONS

International Search Report of PCT/FR2006/001649, filed Jul. 7, 2006, date of mailing Dec. 4, 2006.

* cited by examiner

*Primary Examiner*—Stefanos Karmis
*Assistant Examiner*—Mark J Beauchaine
(74) *Attorney, Agent, or Firm*—Young & Thompson

(57) ABSTRACT

The invention relates to a machine (M) for dispensing products and/or services which are paid for with banknotes. The invention is of the type that comprises a banknote reader (L) which is positioned behind a horizontal insertion slot (F1) and which is used to process banknotes inserted by a user. The aforementioned reader is equipped with an essentially-horizontal inlet slot (F2) serving as an inlet for banknotes. According to the invention, the insertion slot (F1) is disposed at a lower level in relation to the inlet slot (F2) along a vertical reference axis (V). In addition, the machine comprises a guiding interface device (1, 2) which is disposed between the insertion slot (F1) and the inlet slot (F2) such as to guide an inserted banknote from the insertion slot (F1) to the inlet slot (F2).

6 Claims, 3 Drawing Sheets

Figure 1:
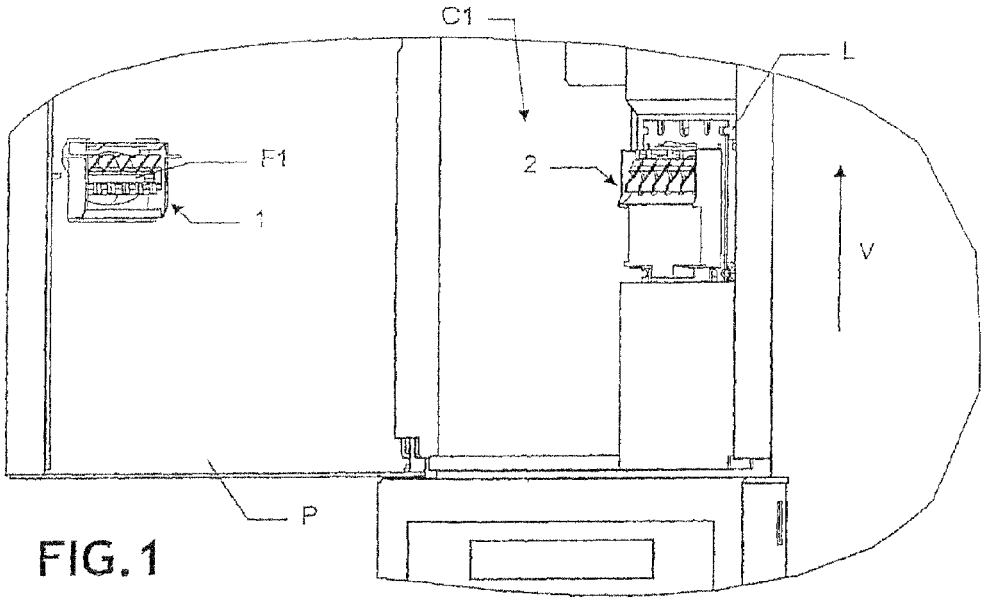

MACHINE FOR DISPENSING PRODUCTS AND/OR SERVICES, WHICH IS EQUIPPED WITH A BANKNOTE READER

This invention relates to the field of machines for dispensing products and/or services against payment by means of banknotes and more specifically relates to the problem of ergonomics associated with the insertion of a banknote into the banknote reader.

Especially in the United States, many machines for the dispensing of products and/or services are equipped with means for payment by banknotes, generally associated with other possible means of payment such as payment using coins and/or credit cards and/or prepaid cards. By way of non-restrictive examples, payment using banknotes is now available for:

drink dispensers, product dispensers, ticket dispensers, parking machines of the timer type, etc.

These machines are designed to be installed in public places, particularly outdoors, and are therefore exposed to the weather.

Now the insertion of a banknote into the banknote reader can be difficult if the banknote is in poor condition, and especially if the banknote is wet. In addition to this, the banknote reader may be damaged by water entering it.

Solutions have already been put forward to protect the banknote reader inlet against rainwater splashes:

A first known solution comprises placing the machine at least partly beneath a lean-to roof. This solution is however completely independent of the machine, and can only be used if environmental constraints permit it.

In a second known solution, a protective screen is located immediately in front of the insertion slot connected to the reader.

In a third known solution, the inlet to the banknote reader is directly protected by a protective moving shutter. This solution is not however very ergonomic because the user has to use both hands in order to insert a banknote while keeping the shutter open.

Neither of the two latter suggested solutions is satisfactory in ergonomic terms. Furthermore, a more than negligible quantity of water can reach the active part of the reader, which could have an adverse effect on the satisfactory operation of the machine.

The object of this invention is to overcome the disadvantages of the known solutions by providing a new arrangement in the product and/or services dispensing machine through which:

on the one hand, water can be prevented from entering the active part of the reader, on the other hand, the ergonomics of inserting the banknote can be adapted in relation. to its quality (banknotes of varying degrees of wetness).

This object is achieved according to the invention which relates to a machine for dispensing products and/or services paid for using banknotes of the type comprising, on one outer side of the machine which is accessible to a user, a slot for the insertion of banknotes which extends substantially horizontally and, within a compartment of the machine, a banknote reader located behind the insertion slot for processing banknotes inserted-. by the user, the said reader having a banknote inlet slot which extends substantially horizontally, the said inlet slot being vertically aligned-. with respect to the said insertion slot, characterised in that the insertion slot is placed at a lower level than the said inlet slot in relation to a vertical reference axis, and in that the machine comprises a guidance interface device located between the insertion slot and the inlet slot in such a way as to guide the passage of banknotes inserted into the insertion slot to the inlet slot.

In a particularly advantageous embodiment of the invention, the guidance interface device comprises a plurality of upper fins extending vertically above the insertion slot and a plurality of lower fins extending vertically below the inlet slot; banknotes are then guided along a guide path of which the top is formed by the lower edges of the said upper fins and the bottom is formed by the upper edges of the said lower fins, the said lower edges facing the said upper edges.

Furthermore, in a particular configuration in which the banknote reader is attached within the compartment and access to the interior of the compartment is made possible by opening a door in the machine, the guidance interface device advantageously comprises at least a first part which is attached to the inside of the door behind the insertion slot and a second part which is attached to the reader in front of the inlet slot, the first part acting together with the second part to guide a banknote when the compartment is closed off by the door.

It can then be provided that the aforesaid upper fins are formed in the first part and the aforesaid lower fins are formed in the second part, the lower and upper edges respectively facing each other to form the guide path when the compartment is closed off by the door.

Figure 4:
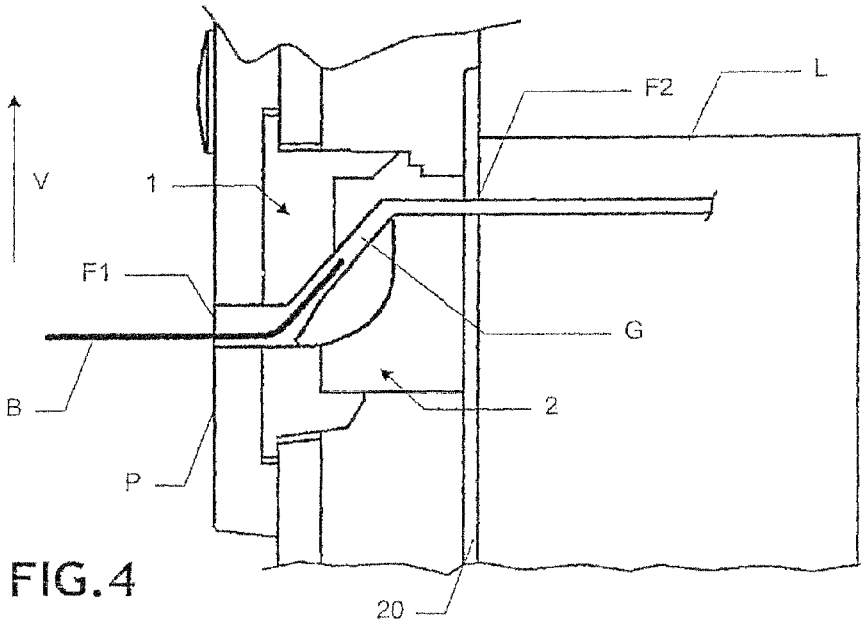
Figure 2:
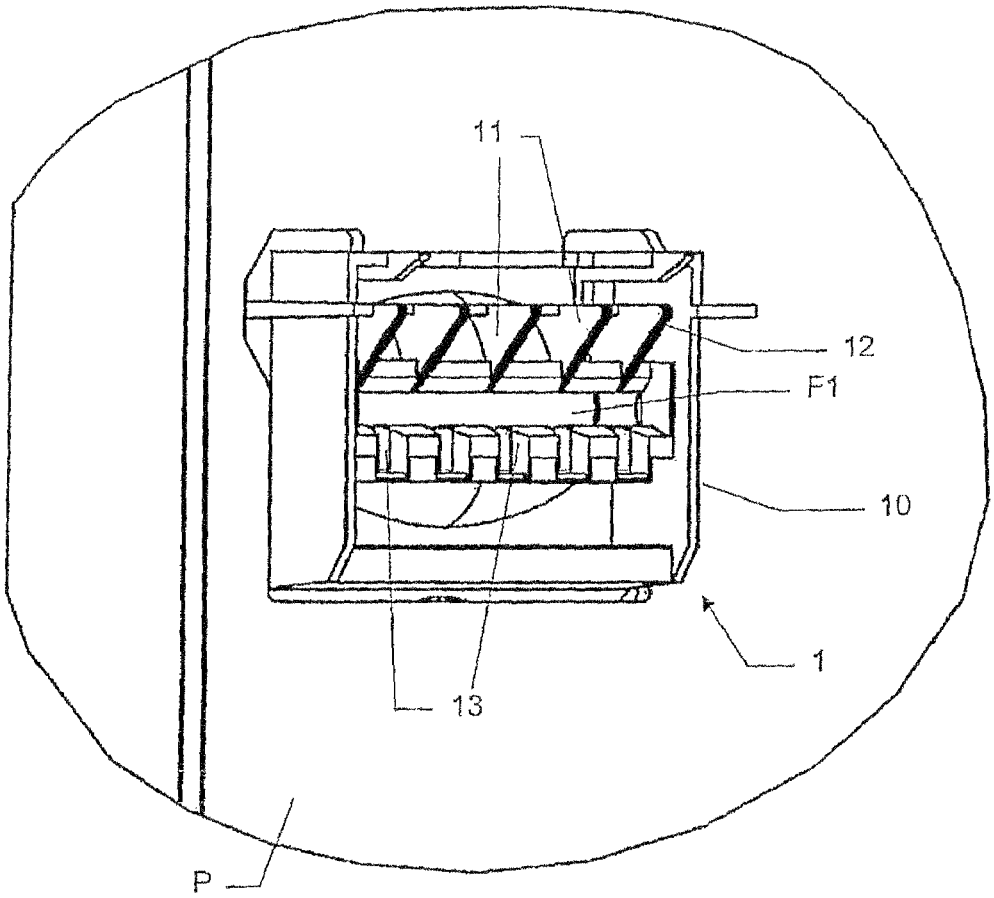
Figure 3:
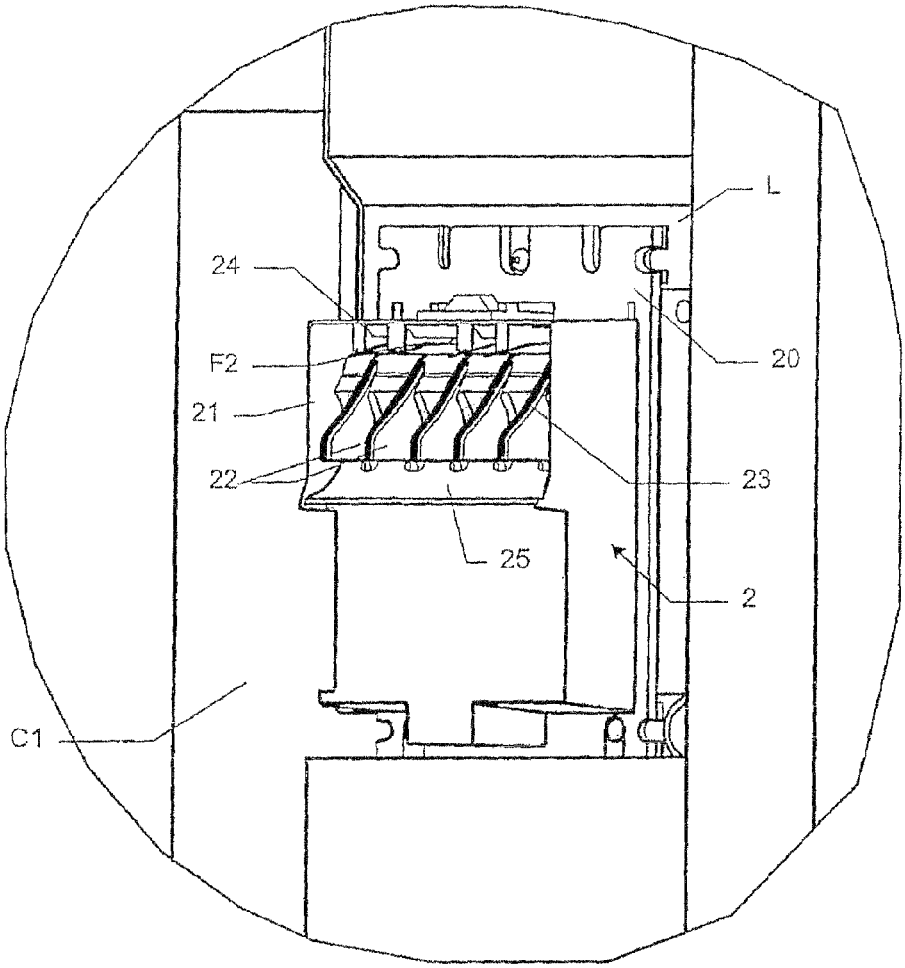

The invention will be better understood from the following description of a preferred but non-restrictive embodiment with reference to the appended figures in which:

FIG. 1 partly illustrates a product and/or services dispensing machine according to the invention, for example a parking machine, in the open position, FIG. 2 is an enlargement of the part of the guidance interface device located on the access door to the compartment of the parking machine in FIG. 1, FIG. 3 is an enlargement of the part of the guidance interface device located on the banknote reader, FIG. 4 illustrates a view in partial cross-section illustrating the guide path when a banknote is inserted.

FIG. 1 diagrammatically and partly illustrates a machine, for example a parking machine in the form of a pillar which. is vertically mounted in relation to a reference vertical axis V.

A banknote reader L is attached within a compartment C1 of the machine. This compartment C1 must be accessible only to maintenance agents who have to work on various components of the machine. Thus the compartment is conventionally closed off by a door P which is here illustrated in the open position. In order to use the machine, a banknote is inserted through an insertion slot F1 which is accessible on the front of door P (which can be seen in FIG. 1 in rear view). For its part reader L also has an inlet slot F2 (see FIGS. 3 and 4). Insertion slot F1 and inlet slot F2 extend substantially horizontally and are of course in vertical alignment.

Conversely, according to an important feature of the invention, as may be seen in FIG. 4, insertion slot F1 is not located at the same level as inlet slot F2 as in known machines, but at a lower level than said inlet slot F2 in relation to a reference vertical axis V. Furthermore, the machine comprises a guidance interface device located between insertion slot F1 and inlet slot F2 to guide the passage of banknotes inserted into insertion slot F1 to inlet slot F2. FIG. 4 illustrates the guide path G followed by banknote B partly and manually inserted into insertion slot F1 by a user. As may be seen, as insertion slot F1 is downwardly offset with respect to inlet slot F2 to reader L, banknote B is caused to follow an S-shaped path.

Simulations by the applicant comprising subjecting the machine according to the invention to a spray on the front of the machine at insertion slot F1 have shown that as a result of this arrangement water does not reach the active part of the reader, and does not therefore risk damaging it.

Furthermore, simulations have also made it possible to demonstrate that a banknote can be inserted very easily with a single hand, and that this can be done regardless of the quality of the banknote.

In the embodiment illustrated in the various figures, the guidance interface device advantageously comprises at least two separate parts constructed for example by moulding plastics material:

a first part 1 attached to the inside of the rear door of insertion slot F1 (see FIGS. 1 and 2), and a second part 2 attached to reader L in front of inlet slot F2 (see FIGS. 1 and 3), the two parts being intended to act together in order to form guide path G when compartment C1 is closed off by door P. More particularly, first part 1 is shaped and located on door P in such a way that it nests within second part 2 attached to the reader when the door is closed. The interior of each of the two parts has matching cut-outs which effectively enable first part 1 to nest in second part 2, and also to create guide path G.

As can be seen in FIG. 3, second part 2 attached to reader L comprises a flat base 20 which is intended to be attached vertically to reader L, and a projecting box 21, of substantially rectangular external shape, of which one face parallel to the fiat base is open in order to receive the matching shape of first part 1. The base of this box has an opening corresponding to inlet slot F2 of the reader. Beneath this inlet slot F2 several identical fins 22, which are preferably regularly spaced, extend vertically within the box and each have an upper edge 23 forming the bottom of the guide path. Thus when banknote B is inserted, its surface is only in contact with the upper edges 23 in second part 2. By thus minimising the contact surface area between the inserted banknote and the guide path, friction is reduced and the risks of the banknote jamming tight are reduced.

With reference to FIG. 2, first matching part 1 also has a box 10 of substantially rectangular shape with a flat surface opposite insertion slot F1 which is open in such a way as to correspond to the open face of second part 2. Within this box 10 there are also regularly spaced fins 11 which extend vertically above insertion slot F1. Each of these fins 11 has a lower edge 12 forming the top of the banknote's guide path. When part 1 nests in part 2 these fins 11 lie opposite to, and more specifically above, fins 22.

Of course first part 1 comprises regularly spaced recesses 13 to allow the lower part of fins 22 to pass into second part 2. Likewise second part 2 has recesses 24 to allow fins 12 of first part 1 to pass.

Finally, as can be seen in FIG. 3, the inside of box 21 of second part 2 attached to the reader advantageously has a bottom wall 25 of concave shape which encourages water to flow towards the exterior.

The ergonomics of insertion can be improved yet further by providing a third part (not shown) of the guidance interface device located on the outside of the door, on the user's side, whose shape can be adjusted to help the user's thumb hold the banknote while it is being inserted and guided to inlet slot F2.

The solution according to invention provides a time saving in the banknote transaction by very substantially improving the ergonomics of insertion. Furthermore, the level of protection against the run-off of rainwater means that the machine can be exposed directly to the weather without the operation of the banknote reader being thereby affected.

Although a single embodiment has been described in the above description, many embodiments may be envisaged without going beyond the scope of the invention. In particular the invention can also be applied to the case where the banknote reader is not attached within the compartment but is attached to the inside of access door P. Furthermore, the guidance interface device may be constructed as a single part which is attached either directly to the front face of the reader or to the door behind the insertion slot. Even in this case it may be envisaged that upper and lower fins of the type described previously are present in the single-piece guidance device in order to limit the risks of cramming.

The invention claimed is:

1. A machine (M) for dispensing products and/or services paid for using banknotes of the type comprising on an external side of the machine accessible to the user, a slot (F1) for the insertion of banknotes extending substantially horizontally and, within a compartment (C1) in the machine, a banknote reader (L) located behind the insertion slot (F1) for processing banknotes inserted by a user, the said reader having a banknote inlet slot (F2) extending substantially horizontally, the said inlet slot (F2) being vertically aligned with respect to the said insertion slot, wherein the insertion slot (F1) is located at a lower level than the said inlet slot (F2) in relation to a vertical reference axis (V) and wherein the machine comprises a guidance interface device (1, 2) placed between the insertion slot (F1) and the inlet slot (F2) in order to guide the passage of a banknote inserted into the insertion slot (F1) to the inlet slot (F2), the banknote reader (L) being attached within the compartment (C1), and access within the compartment (C1) being made possible by opening a door (P) in the machine, the guidance interface device having at least a first part (1) attached to the inside of the door behind the insertion slot (F1) and a second part (2) attached to the reader (L) in front of the inlet slot (F2), the first part (1) acting together with the second part (2) to guide a banknote when the compartment (C1) is closed off by the door (P).

2. A machine according to claim 1, wherein the guidance interface device comprises a plurality of upper fins (11) extending vertically above the insertion slot (F1) and a plurality of lower fins (22) extending vertically below the inlet slot (F2), the banknote being guided along a guide path (G) the top of which is formed by the lower edges (12) of the said upper fins (11) and the bottom of which is formed by the upper edges (23) of the said lower fins (22), the said lower edges (12) being opposite to the said upper edges (23).

3. A machine according to claim 2, wherein the said upper fins (11) are formed in the first part (1) and the said lower fins (22) are formed in the second part (2), the lower (12) and upper (23) edges respectively facing each other in order to form the guide path when the compartment (C1) is closed off by the door (P).

4. A machine according to claim 1, wherein the second part (2) comprises a flat base (20) which is intended to be attached vertically to the reader (L) and a projecting box (21) whose base has an opening corresponding to the inlet slot (F2) of the reader (L), one face of which parallel to the flat base is open.

5. A machine according to claim 4, wherein the interior of the box (21) comprises a bottom wall (25) of concave shape encouraging the run-off of water.

6. A machine according to claim 1, wherein the first part (1) and the second part (2) are constructed by moulding a plastics material.

* * * * *